US006180183B1

(12) United States Patent
Wentland et al.

(10) Patent No.: US 6,180,183 B1
(45) Date of Patent: Jan. 30, 2001

(54) COPPER-BASED ALLOY CASTING PROCESS

(75) Inventors: William L. Wentland; William T. Dill, both of Rockford, IL (US)

(73) Assignee: Hamilton Sundstrand Corporation, Rockford, IL (US)

( * ) Notice: Under 35 U.S.C. 154(b), the term of this patent shall be extended for 0 days.

(21) Appl. No.: 09/224,225

(22) Filed: Dec. 30, 1998

Related U.S. Application Data

(63) Continuation-in-part of application No. 08/752,362, filed on Nov. 19, 1996, now Pat. No. 5,943,942.

(51) Int. Cl.[7] ..... B05D 1/18; B05D 7/22; B23P 11/00

(52) U.S. Cl. ..... 427/431; 427/235; 427/239; 427/436; 427/398.1; 29/527.6; 29/888.061; 29/898.12

(58) Field of Search ..... 427/398.1, 431, 427/436, 235, 239; 29/527.6, 888.06, 888.061, 898.12

(56) References Cited

U.S. PATENT DOCUMENTS

| | | | | |
|---|---|---|---|---|
| 1,789,979 | * | 1/1931 | Jones et al. . | |
| 3,319,575 | | 5/1967 | Havens . | |
| 3,550,233 | | 12/1970 | Rubery et al. . | |
| 3,803,687 | | 4/1974 | Alger, Jr. et al. . | |
| 3,808,659 | * | 5/1974 | Alger, Jr. et al. | 29/156.4 WL |
| 4,142,011 | * | 2/1979 | Gierek et al. | 427/431 |
| 5,080,056 | * | 1/1992 | Kramer et al. | 123/193 CP |
| 5,085,127 | | 2/1992 | Gantzer . | |

* cited by examiner

*Primary Examiner*—Timothy Meeks
*Assistant Examiner*—Michael Barr
(74) *Attorney, Agent, or Firm*—Wood, Phillips, VanSanten, Clark & Mortimer

(57) ABSTRACT

A cost-effective process for providing a copper-based alloy casting, which has superior wear characteristics, to a cylinder block is described. The process includes heating the copper-based alloy to a molten state for immersing the cylinder block within such, while promoting the entrained gas within the copper-based alloy to migrate in a given direction and terminate in a specified portion of the copper-based alloy to effectively control porosity. In one form, the process further includes cooling the immersed cylinder block in the given direction to effectively reduce microshrinkage of the copper-based alloy.

22 Claims, 7 Drawing Sheets

COPPER-BASED ALLOY CASTING PROCESS

This application is a continuation-in-part of application Ser. No. 08/752,362 filed Nov. 19, 1996 now U.S. Pat. No. 5,943,942 entitled "Copper-Based Alloy Casting Process" and naming William T. Dill and William L. Wentland as inventors, the entire disclosure of which is incorporated herein by reference.

FIELD OF THE INVENTION

This invention relates to hydraulic pumps and motors, and more particularly to processes for providing copper-based alloy castings to cylinder blocks within such pumps and motors.

BACKGROUND OF THE INVENTION

Axial piston pumps and motors as used in the aerospace industry operate under harsh environmental conditions and often are subject to significant stress concentration levels. That stress arises because pistons reciprocate at high velocities and simultaneously rotate in relation to piston bores formed within a cylinder block. In certain applications, such as an aircraft integrated drive generator (IDG), the relationship of each piston to its respective piston bore within the cylinder block is preferably controlled within a tight diametral clearance range, such as 0.0001" to 0.0004". In such an arrangement to produce 400 Hz electric power, for example, oil is pumped into and/or out of the piston bores at up to approximately 6000 psi.

Each cylinder block of an IDG typically contains nine pistons; and each IDG typically contains four cylinder blocks per aircraft engine. Thus, to increase service reliability of the aircraft and reduce periodic maintenance, minimal wear of the pistons on associated cylinder block bores is desirable. In order to protect the piston bores from the harsh, aircraft operating environments, a bushing may be inserted into each of the piston bores to reduce sliding friction and wear caused by piston movement. An example of a preferable piston embodiment for movement within a cylinder block is disclosed in U.S. Pat. No. 3,319,575 to Havens.

One previous method of manufacturing the cylinder block with bushings includes diffusion bonding each of the nine bushings to a respective piston bore surface. This process requires separate machining of each of the piston bores within a tightly controlled tolerance measurement to match outer diametral bushing dimensions. In addition, separate manufacture of each of the nine bushings within correspondingly tight inner and outer diametral dimensions is required. Such a process further requires interference fitting each of the bushings into the piston bores, before applying pressure to diffusion bond the material of the bushing, usually bronze, and the material of the cylinder block which defines the surface of the piston bore, usually steel, together.

In addition, each cylinder block may include a valve plate, sometimes referred to in the art as a "port plate", which is secured to an end of the cylinder block. The valve plate rotates with the cylinder block in operation to regulate the amount of propulsive oil entering and exiting each piston bore. Such a plate is preferably constructed from the same wear resistant material as the bushings. The aforementioned diffusion bonding process has also been utilized to secure the valve plate to the end of the cylinder block. However, this requires an additional piece of hardware to be manufactured and separately bonded to the cylinder block.

Thus, the prior diffusion bonding process poses significant manufacturing obstacles, as each machining operation and processing step requires additional labor and production cost; and the tightly toleranced dimensions often result in an increased amount of scrap material. These obstacles address the downfalls associated with the construction process. However, more serious performance-driven problems can be encountered by using a diffusion bond to secure the bronze bushings and the valve plate to the cylinder block. During a diffusion bonding process, the bronze material of the bushings and the valve plate never reach a molten state. Because of this, gas and other impurities can become entrapped within the bronze material. Once the pressure applied during the process is relieved, the bushing may be left with significant amounts of porosity. In addition, diffusion bonding can result in microshrinkage, as volumetric changes in the bronze material occur during cooling. Microshrinkage results in microscopic voids near the surface of the bushing and the valve plate surfaces. These entrapped gases and voids in the bushing surfaces create stress risers. Since bronze material which has been diffusion bonded tends to be soft (i.e. 18–45 $HR_B$), the voids and/or entrapped gases greatly decrease the bushings' ability to reduce friction and wear caused by piston movement. Thus, the piston in operation creates a wear path in the bushing. The extra clearance in the piston bore caused by this piston wear can trigger fluid leakage in the cylinder block and piston assembly. Excess leakage can result in low charge pressure, and electrical performance frequency ratings of the IDG from being reached. Eventually, the wear can cause the hydraulic unit to completely malfunction.

Accordingly, objects of the present invention include providing an improved process of forming a copper-based alloy casting substantially free of voids or entrained gas on a cylinder block, and providing an advanced cylinder block design, which has advantageous wear reduction characteristics. Other objects of the invention include the following:

(i) to provide a cost-effective method for manufacturing a cylinder block with a copper-based alloy casting;

(ii) to eliminate separate construction operations for each bushing and the valve plate;

(iii) to eliminate separate assembly operations for each bushing within the cylinder block;

(iv) to eliminate separate assembly of the valve plate to the cylinder block;

(v) to create a copper-based alloy casting with superior wear characteristics including ductility, strength, hardness, and cavitation resistance;

(vi) to effectively reduce microshrinkage of the bushing and valve plate surfaces during processing;

(vii) to effectively control porosity to a specified location of the copper-based alloy during the manufacturing process;

(viii) to effectively isolate impurities of the casting material to a specified location of the copper-based alloy during the manufacturing process;

(ix) to increase service reliability of the cylinder block; and (x) to provide a plurality of wear-resistant annular members which are functionally equivalent to the bushings and valve plate, but integrally cast as part of the cylinder block.

SUMMARY OF THE INVENTION

In one form, this invention relates to a method of providing a copper-based alloy casting, which is substantially free of voids or entrained gas, to a cylinder block by controlling the direction and conditions under which the cylinder block is immersed and cooled. Each cylinder block includes a first end, a second end opposite to the first end, and at least one piston bore extending through the cylinder block.

In one form, the inventive process includes an initial step of providing a negative pressure around the cylinder block and a copper-based alloy. The negative pressure creates a vacuum which promotes entrained gas contained within the copper-based alloy to migrate in a given direction as the copper-based alloy is heated. The process further includes a step of heating the copper-based alloy to a molten state. The heating step causes the cylinder block to immerse in the molten copper-based alloy in a gravitational direction. The heating further promotes the entrained gas to migrate in the given direction which is opposite to the gravitational direction. The migration of entrained gas terminates in an extreme portion of the copper-based alloy which is adjacent to the second end of the cylinder block.

Preferably, the process includes a step of cooling the copper-based alloy and the immersed cylinder block in the given direction beginning from the first end of the cylinder block. The cooling step further promotes the entrained gas contained within the copper-based alloy to migrate to the extreme portion which is adjacent to the second end of the cylinder block. Additionally, the method preferably includes a step of providing a weighted thermally insulative housing which promotes the cylinder block to immerse in the molten copper-based alloy. The weighted housing further acts to insulate the second end of the cylinder block and promote cooling of the copper-based alloy from the first end of the cylinder block. In one aspect of the invention, it is preferred that the weighted housing include carbon material that will react with oxygen to reduce oxidizing of the cylinder block.

In one aspect of the invention, to create production hardware, the method includes removing the extreme portion of the cooled copper-based alloy. This extreme portion contains the voids and entrained gas located adjacent to the second end of the cylinder block. Finally, a copper-based alloy annulus may be formed within the piston bore by removing a portion of the cooled copper-based alloy from the piston bore.

The invention further contemplates a cylinder block which includes a copper-based alloy casting formed by the aforementioned process. The cylinder block production process may include the preferable steps of cooling the copper-based alloy and immersed cylinder block in the given direction; providing a weighted thermally insulative housing; removing the extreme portion of the cooled copper-based alloy; and forming a copper-based annulus within the piston bore.

The invention further contemplates an advanced design of a cylinder block which has advantageous wear characteristics. The cylinder block includes a housing having a substantially cylindrical bore extending therethrough. The substantially cylindrical bore terminates at an end of the housing, which defines a bearing surface. The cylinder block further includes a substantially voidless annular member which is cast from a copper-based alloy and integrally coupled to the housing within the bore.

Preferably, the cylinder block also includes a substantially voidless annular plate member which is cast from the copper-based alloy and integrally coupled to the bearing surface of the housing. The annular member may integrally include the annular plate member as a projection which extends radially outwardly from an extreme portion of the annular member adjacent to the end of the housing. Preferably, the substantially voidless annular copper-based alloy member is moltenly bonded to the housing within the bore.

As another aspect of the invention, a method provides a copper based alloy casting in a cylinder block having a first end, a second end opposite the first end, and at least one cavity. The method includes the steps of placing the first end of the cylinder block adjacent a mass of copper-based alloy, heating the mass of copper-based alloy to a molten state where at least the first end of the cylinder block is immersed into the mass of copper-based alloy by a force applied to the cylinder block in the mass of copper-based alloy.

According to a further aspect of the invention, the heating step includes induction heating the mass of copper-based alloy to a molten state where at least the first end of the cylinder block is immersed into the mass of copper-based alloy by said force.

According to another aspect of the invention, a method provides a cast copper-based alloy bushing in a bore of a machine component. The method includes the steps of placing the machine component adjacent a mass of copper-based alloy, heating the mass of copper-based alloy to a molten state where a force applied to the machine component and the mass of copper-based alloy immerses at least a portion of the machine component into the mass of copper-based alloy with at least some of the copper-based alloy flowing into at least a portion of the bore; cooling the mass of copper-based alloy and the machine component to solidify the mass of copper-based alloy; and removing a portion of the copper-based alloy in said bore to form a cast copper-based alloy bushing in said bore.

In accordance with one aspect of the invention, the heating step includes induction heating the mass of copper-based alloy to a molten state where the force immerses at least a portion of the machine component into the mass of copper-based alloy with at least some of the copper-based alloy flowing into at least a portion of the bore.

Other objects, aspects, and advantages of the invention will become readily apparent upon consideration of the following drawings and detailed descriptions of preferred embodiments.

BRIEF DESCRIPTION OF THE DRAWINGS

For drawing FIGS. 2–4 and 6–7 included herewith, gravitational force acts in a generally downward direction, as specifically illustrated by vector 100, when each figure is viewed with the reference numerals in their normally upright position. In all figures, like reference numerals indicate like elements or features.

DETAILED DESCRIPTION OF THE PREFERRED EMBODIMENT

Figure 1:
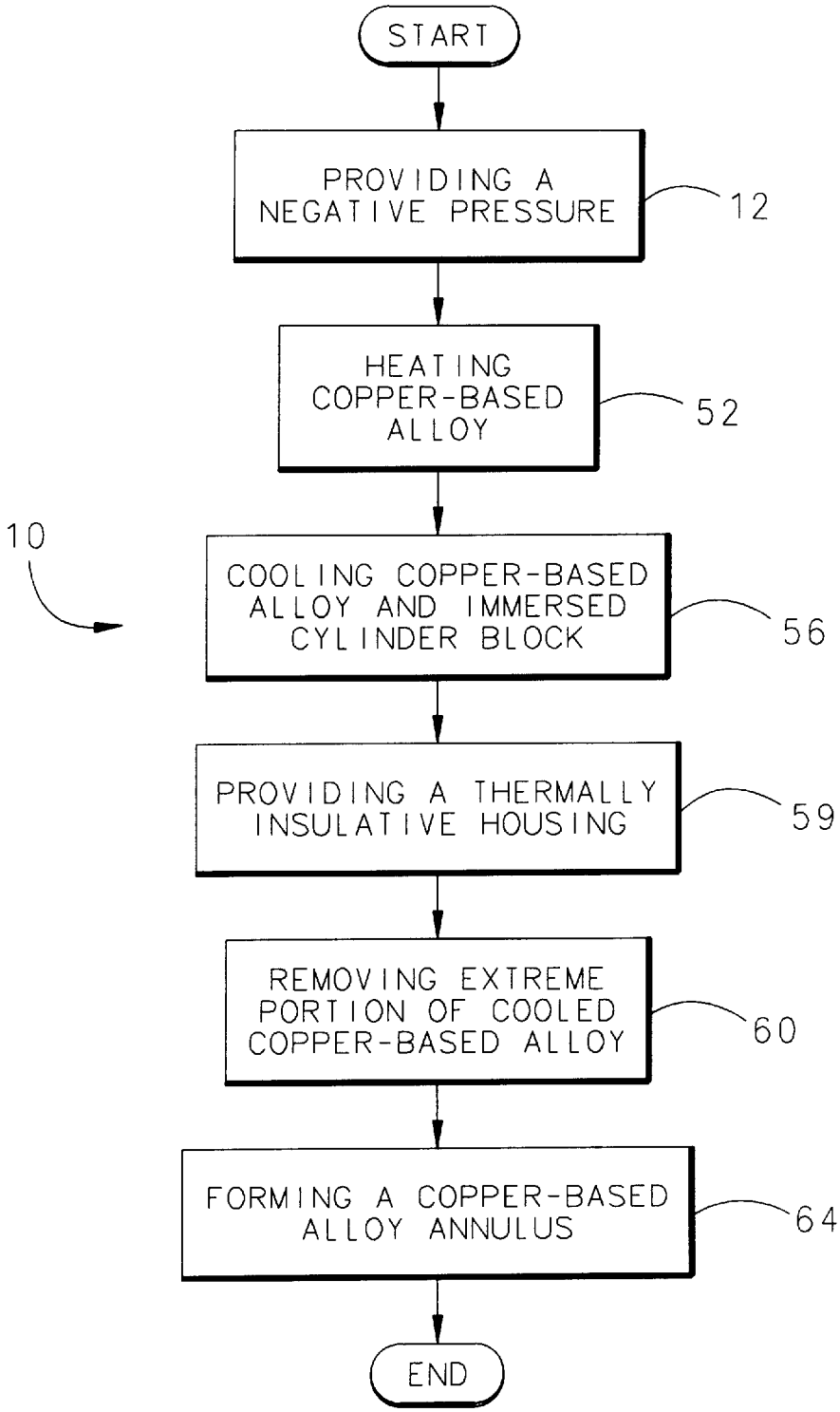
FIG. 1 is a flow diagram for a casting process according to the present invention.
Figure 2:
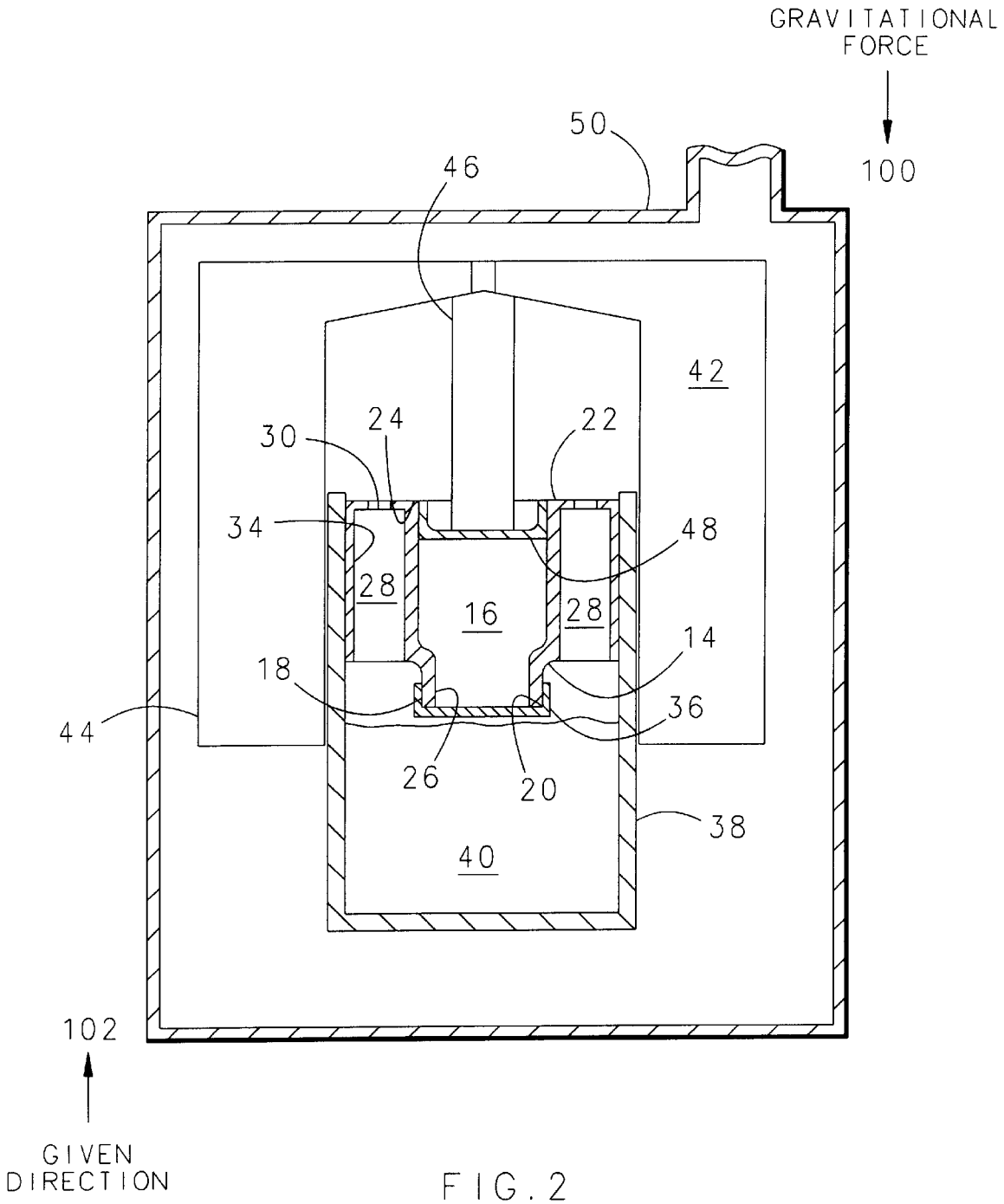
FIG. 2 is a schematic cross-sectional view of a cylinder block during an initial stage of the casting process.
Figure 3:
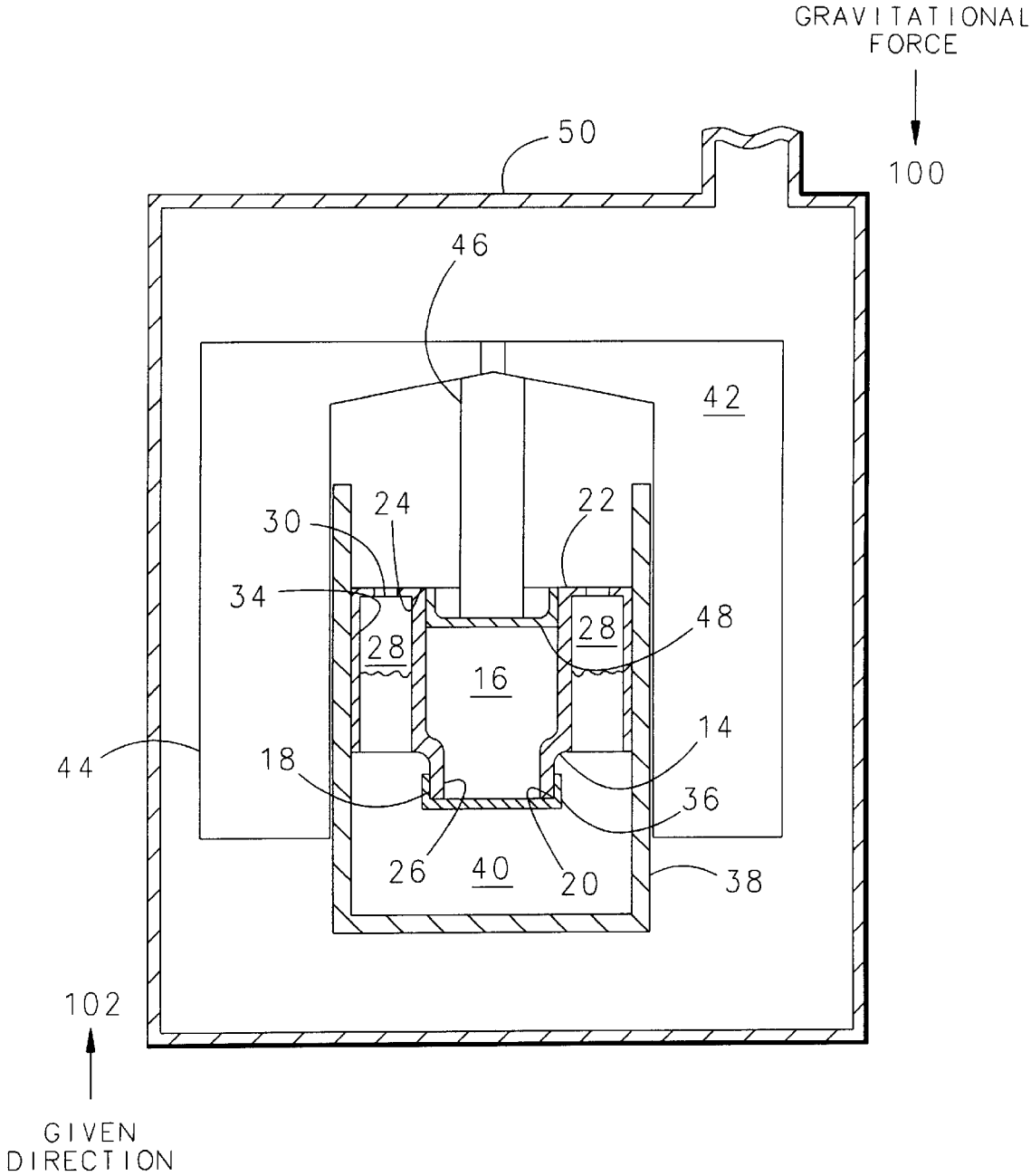
FIG. 3 is a schematic cross-sectional view of a cylinder block during the casting process, in which the cylinder block is partially immersed in the molten copper-based alloy.
Figure 4:
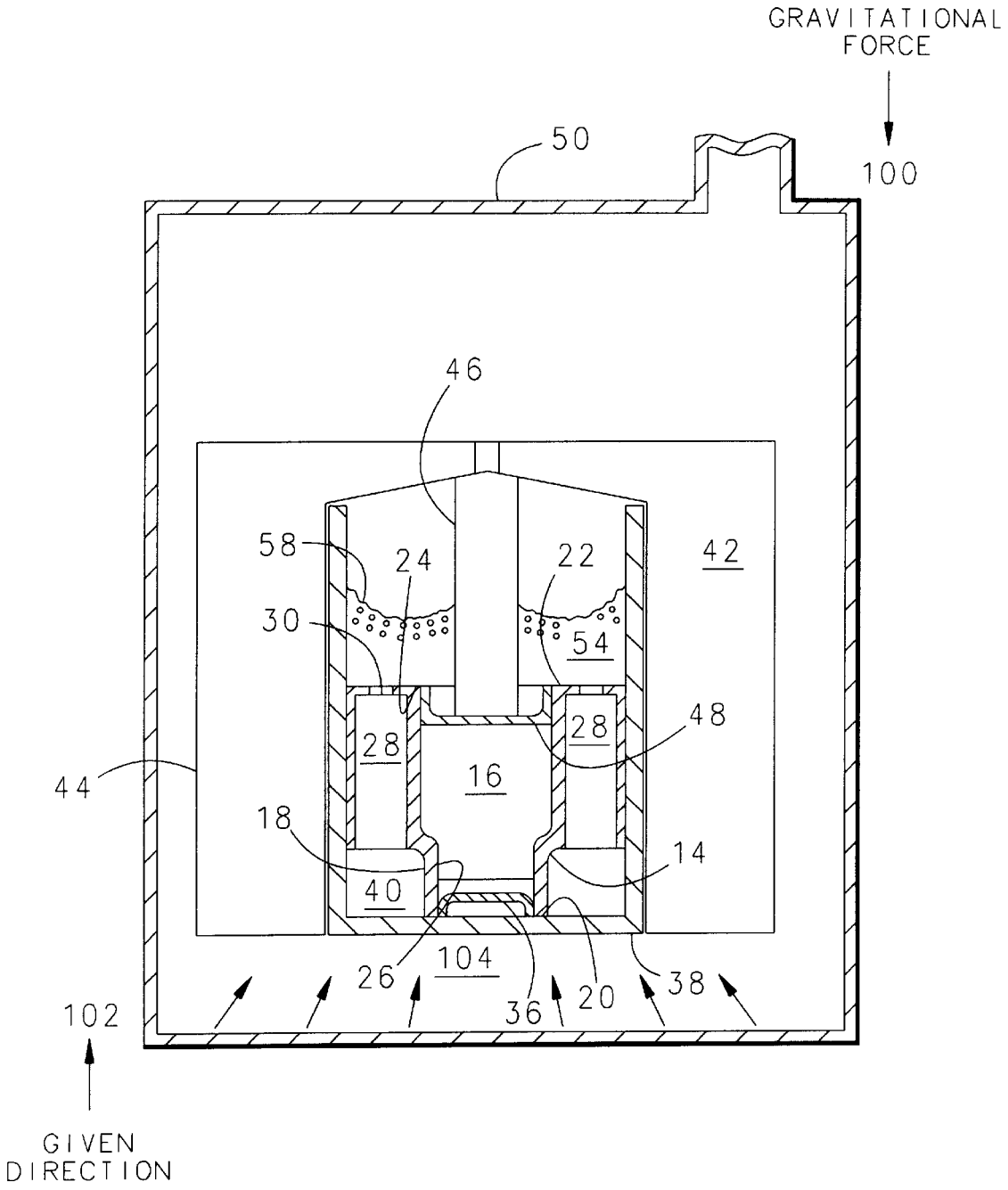
FIG. 4 is a schematic cross-sectional view of a cylinder during a further embodiment of the casting process, in which the immersed cylindrical block is cooled in a given direction.

FIG. 1 illustrates a flow diagram for an exemplary embodiment of a process, generally depicted 10, for providing a copper-based alloy casting which is substantially free of voids and/or entrained gas to a machine component, such as a cylinder block 14. FIGS. 2–4, when viewed in conjunction with FIG. 1, depict various stages of the casting process 10.

As shown in FIG. 2, a sealed assembly 16 includes the cylinder block 14 which has a first end 18 defined by an end surface 20, and a second end 22 defined by a bearing surface 24. Bearing surface 24 is opposite to the end surface 20 of the first end 18. While the external shape of the block 14 need not be cylindrical in shape, it is typically referred to in the art as a "cylinder". The cylinder block 14 includes a spline 26 which can engage a respective splined portion on a shaft (not shown). When the spline 26 of the cylinder block 14 is engaged with the shaft, the block 14 can rotate for use in a conventional hydraulic pump or motor. Preferably, the cylinder block 14 of an aircraft integrated drive generator (IDG) is constructed from ASTM A681, CL A6 electroslag remelted (ESR), spheroidized annealed steel.

The cylinder block 14 includes a plurality of axially disposed piston bores 28. The piston bores 28 are typically arranged in an annular array about an axis of rotation 27 (FIG. 5) concentric with the shaft. Preferably, an aircraft IDG unit contains nine piston bores 28; although only two such bores are illustrated in the cross-section of FIG. 2. Each of the piston bores 28 communicates with a corresponding piston bore passage 30 formed in the bearing surface 24 of the second end 22 of the cylinder block 14. The piston bores 28 extend from the piston bore passages 30 of the second end 22 to the first end 18 of the cylinder block 14. Preferably, each piston bore 28 is substantially cylindrical in nature and defines a piston bore surface 34. To suitably prepare the piston bores 28 for treatment by the inventive process, each can be machined with rough diametral tolerances of ±0.001".

The sealed assembly 16 further includes a freeze or expansion plug 36 which protects the integrity of the spline 26 during the casting process. Preferably, the freeze plug 36 is constructed of 300 series stainless steel. While FIG. 2 depicts a plug which caps the first end 18 on an outer diameter of the cylinder block 14, FIG. 4 illustrates an alternative embodiment of the plug 36 which is interference fit within an inner diameter of the cylinder block 14 at the first end 18. In the FIG. 4 plug embodiment, the inner diameter should preferably have a 64√ maximum surface finish to obtain an adequate interference fit for preventing leakage and contamination of the spline 26 during the casting process 10.

A generally cylindrical container 38 is provided to hold a copper-based alloy 40, such as bronze. Preferably, the copper-based alloy 40 is constructed from cylindrical bar stock in accordance with ASTM B505, UNS. No. C93700, except the phosphorus content should be 0.05% maximum by weight. The copper-based alloy 40 can be slip fit into the container 38 in preparation for the casting process 10.

As depicted in FIG. 2, a generally cylindrical cover or housing 42 is provided over the cylinder block 14 via step 59. Preferably, the housing 42 is constructed from a thermally insulative material such as carbon. An example of a suitable material which may be utilized to form the housing is known and sold in the industry under the trademark Purebon® P-4107 and manufactured by Pure Carbon Company, Inc. A further example of a carbon housing material which may be utilized is sold under the tradename "UCAR" Grade CVN by Union Carbide Corporation.

As shown in FIG. 2, the thermally insulative housing 42 includes an annulus portion 44 of which an inner diameter is substantially the same dimension as an outer diameter of the container 38. This sizing arrangement allows the annulus portion 44 of the housing 42 to translate along a length of the container 38 in the gravitational direction, as shown by the vector 100, while substantially sealing and insulating the sealed assembly 16 and the copper-based alloy 40 within the container 38. Additionally, the graphite material of the housing 42 tends to more readily attract oxygen than the steel surfaces of the cylinder block 14, thereby reducing oxidation on the surface of the cylinder block 14.

The insulative housing 42 is connected to a threaded bolt 46 which extends coaxially in relation with the housing 42 and substantially concentric with respect to the annulus portion 44. Preferably, the threaded bolt 46 is secured to an additional freeze plug 48 which protects the spline 26 from the second end 22 of the cylinder block 14. The plug 48 can be constructed and inserted in a similar fashion to that of plug 36. An alternate embodiment contemplated by the inventive process 10 includes utilizing a push rod and weight (not shown) or other rigid member which provides axial displacement between the insulative housing 42 and the second end 22 of the cylinder block 14.

In preparation for the cylinder block 14 to be cast by the inventive process 10, preliminary steps can be undertaken to further ensure a desirably processed block. First, the cylinder block 14 can be demagnetized to remove any steel dust which is partially magnetized to the block 14 because of machining. Next, the sealed assembly 16 and the copper-based alloy 40 can be degreased in a degreasing solvent to remove excess oil and grease which accumulates during handling of the steel and bronze materials. Additionally, the sealed assembly 16 can be rinsed in a suitable isopropyl alcohol solution or acetone, and force air dried to remove any remaining impurities.

As shown in FIGS. 1 and 2, the casting process 10 begins with an initial step 12 of providing a negative pressure around the cylinder block 14 and the copper-based alloy 40 via a vacuum furnace 50. The vacuum furnace 50 preferably should be of a type which can control cooling direction from the first end 18 of the cylinder block 14, when the cylinder block 14 is positioned in the vacuum furnace 50 with the thermally insulative housing 42 above the sealed assembly 16. By positioning the cylinder block 14 in this manner surrounded by a negative pressure, this arrangement promotes any entrained or entrapped gas within the copper-based alloy 40 to migrate upward in a given direction, generally depicted by vector 102, as the sealed assembly 16 is immersed within the copper-based alloy 40. As appreciated in FIGS. 2 and 3, the given direction of vector 102 is substantially opposite in direction to the gravitational direction, depicted by vector 100.

The furnace 50 can be preheated to 950° F.±50° F. until the complete load within the furnace 50, including the sealed assembly 16, the thermally insulative housing 42 and the copper-based alloy 40, reaches the preheat temperature. Preferably, if this preheating step is employed, the vacuum level of the furnace 50 should be held between 10–1,000 microns, once the furnace temperature reaches 600° F. Preheating is advantageous to the casting process 10 because it allows the cylinder block 14 to approach the casting temperature in a graduated manner, rather than by shocking a room temperature steel block with extremely hot bronze material. An alternative preheat to that described above, includes convection heating at one atmosphere of $N_2$ to a preheat temperature of 1200° F.

As illustrated in FIG. 1, the casting process 10 continues with a step 52 of heating the copper-based alloy 40 to a molten state along with the sealed assembly 16. Preferably, step 52 includes heating to a temperature above 1000° F. and backfilling the furnace 50 with $N_2$ to a partial vacuum of 10–380 Torr, while increasing the temperature to 1850° F.±25° F. Referring to FIG. 3, as the copper-based alloy 40 reaches a molten state, the weight of the carbon cover 42 promotes the cylinder block 14 to move in the gravitational direction of vector 100 and immerse in the molten copper-based alloy 40.

As the first end 18 of the cylinder block 14 immerses to the bottom of the container 38, as illustrated in FIG. 4, it is preferable to hold the sealed assembly 16 at a temperature of 1850° F.±25° F. for a period of 30–60 minutes. This time frame allows the molten bronze and steel materials to react sufficiently to form a molten bond. However, at temperatures above this preferable range, adverse metallurgical conditions can result with the steel. The extended period additionally promotes any entrained gas and impurities of the bronze stock to migrate through the piston bores 28 and the piston bore passages 30 in the given direction of vector 102. As the entrapped gas migrates through the piston bores 28 in the given direction, it moves to an extreme portion 54 of the copper-based alloy 40. This extreme portion 54, as shown in FIG. 4 is adjacent to the second end 22 of the cylinder block 14. Thus, one can appreciate in light of this description, this "bottom casting" arrangement enables control of the direction of immersion of the cylinder block 14 in conjunction with the direction of movement of entrained gas.

After the heating step 52, the process 10 includes a step 56 of cooling the immersed assembly 16 by inert gas beginning from the first end 18 of the cylinder block 14. Cooling occurs in the given direction as illustrated by vectors 104 in FIG. 4. Preferably, step 56 is accomplished by quenching the first end 18 with $N_2$ gas to cool the sealed assembly 16 and migrated copper-based alloy 40 to less than 150° F.

As the copper-based alloy 40 is cooled from the first end 18, entrained gas within the bronze is further promoted to migrate to the extreme portion 54. This "bottom cooling" effect is enhanced because the carbon housing 42 is thermally insulative of the second end 22 of the copper-based alloy 14. In such an arrangement, the copper-based alloy 40 does not instantaneously cool from liquid to solid, but rather gradually cools and changes state beginning from the first end 18.

During this liquid to solid change of state, the copper-based alloy 40 volumetrically decreases. Since the housing 42 is insulating the second end 22 of the cylinder block 14 as the first end 18 cools, molten bronze from the second end 22 flows down in the gravitational direction 100 to make up any difference in volume. As the copper-based alloy 40 flows downward, the extreme portion 54 is left with voids where the bronze unevenly flows. Thus, the resulting microshrinkage, generally depicted by 58, is controlled and isolated in the extreme portion 54 of the hardened copper-based alloy 40 adjacent to the second end 22 of the cylinder block 14.

Once 150° F. is reached, the hardened assembly 16 can be removed from the vacuum furnace 50 and allowed to cool to room temperature. Next, the insulative cover 42 can be removed from the hardened assembly 16 by detaching the housing 42 from the threaded bolt 46. This allows the carbon cover 42 to be reused while utilizing a fairly inexpensive bolt as a consumable item. The assembly 16 can then be set into a deep freeze at −110° F.±10° F. for at least one hour before warming to room temperature. This freezing step improves the steel properties of the cylinder block 14 after having been subjected to the casting process 10. Preferably, the resulting steel hardness of the cylinder block 14 should be between 50–55 $HR_B$.

Figure 5:
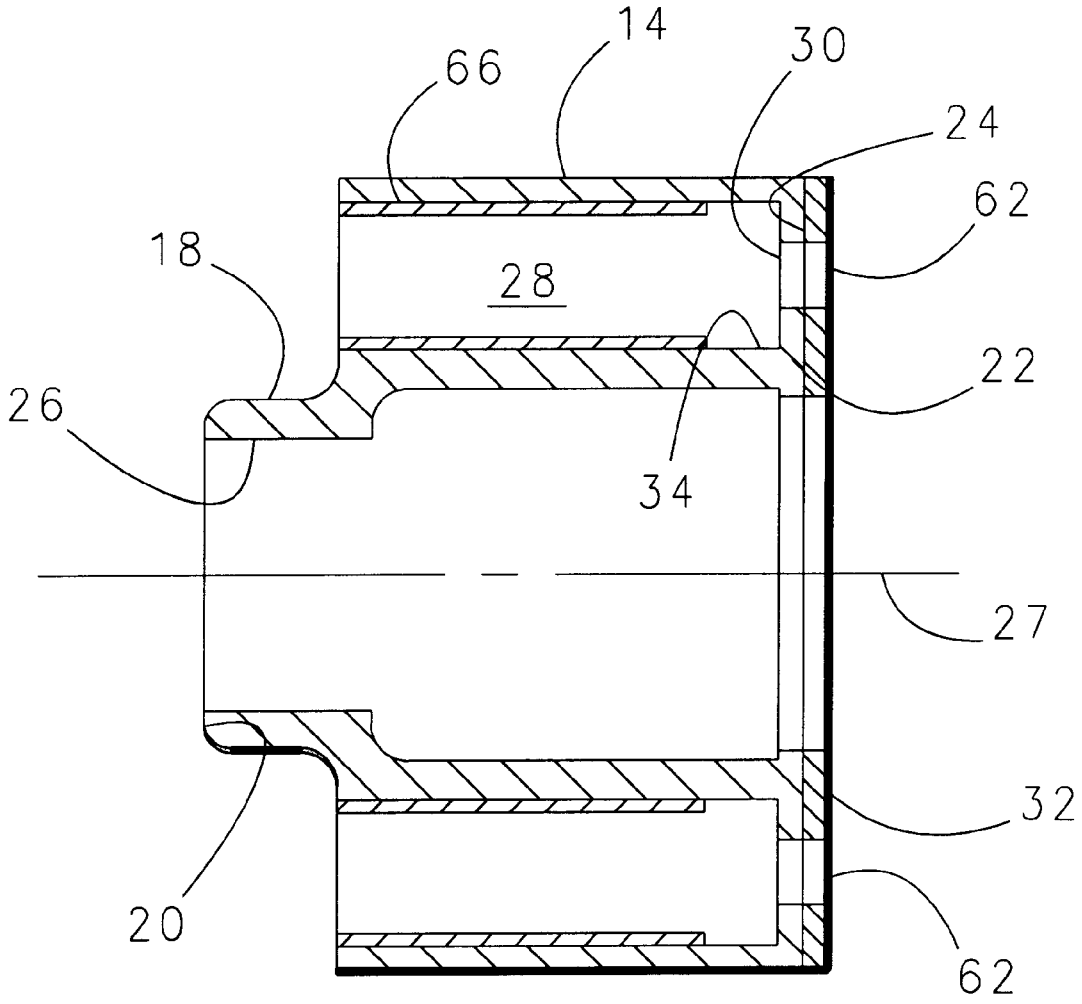
FIG. 5 is a schematic cross-sectional view of a preferred embodiment of a cylinder block according to the present invention.

In order to create a finished cylinder block 14 as illustrated in FIG. 5, the process 10 can include a machining step 60. Step 60 includes removing the extreme portion 54 of the cooled copper-based alloy 40 which contains the entrained gas and microshrinkage 58. By removing this extreme portion 54 adjacent to the second end 22, an annular plate member 32 cast from the copper-based alloy 40 is created as being integrally coupled to the bearing surface 24 of the cylinder block 14. This annular plate member 32 is typically referred to as a valve or port plate. The valve plate 32 may be further machined to include a plurality of fluid inlet and outlet passages 62. The fluid passages 62 serially communicate with each piston bore passage 30 during operation of the cylinder block 14. The fluid passages 62 allow oil to flow through the piston bore passage 30 and into the piston bore 28 as the cylinder block 14 rotates to provide hydraulic power and lubrication of the piston bore surface 34.

Each piston bore surface 34 may be formed in a step 64 of the process 10 by removing a portion of the cooled copper-based alloy 40 from the piston bore 28. This processing step 64 creates an annular member 66 which is preferably cast from bronze, substantially free of voids, and integrally coupled to the cylinder block 14 within the piston bore 28. Such an arrangement provides a molten bond between the bronze and steel materials which has superior wear characteristics of hardness, ductility, strength and cavitation resistance.

Figure 6:
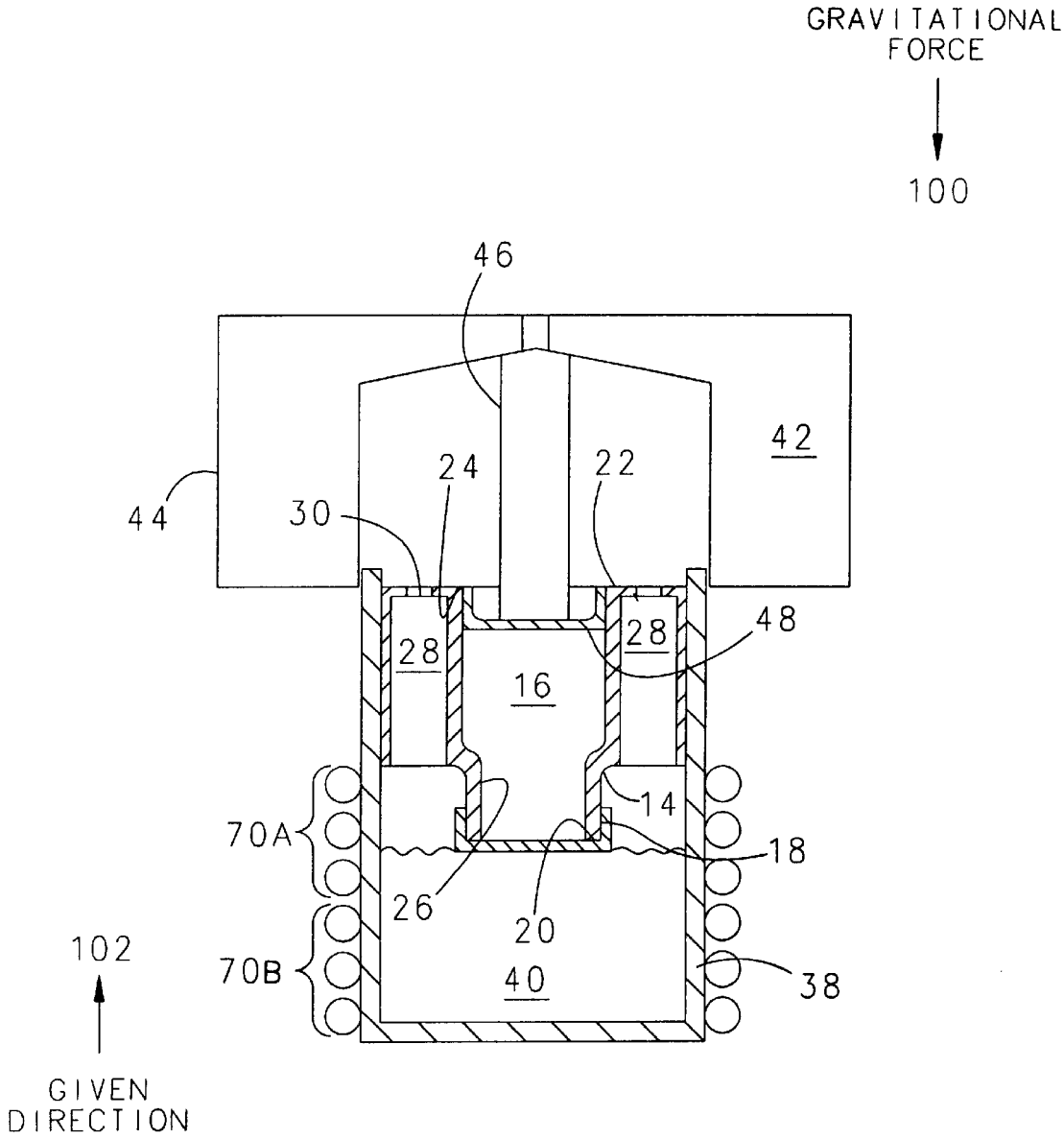
FIG. 6 is a schematic cross-sectional view of a cylinder block during an initial stage of an alternate embodiment of the casting process according to the invention.
Figure 7:
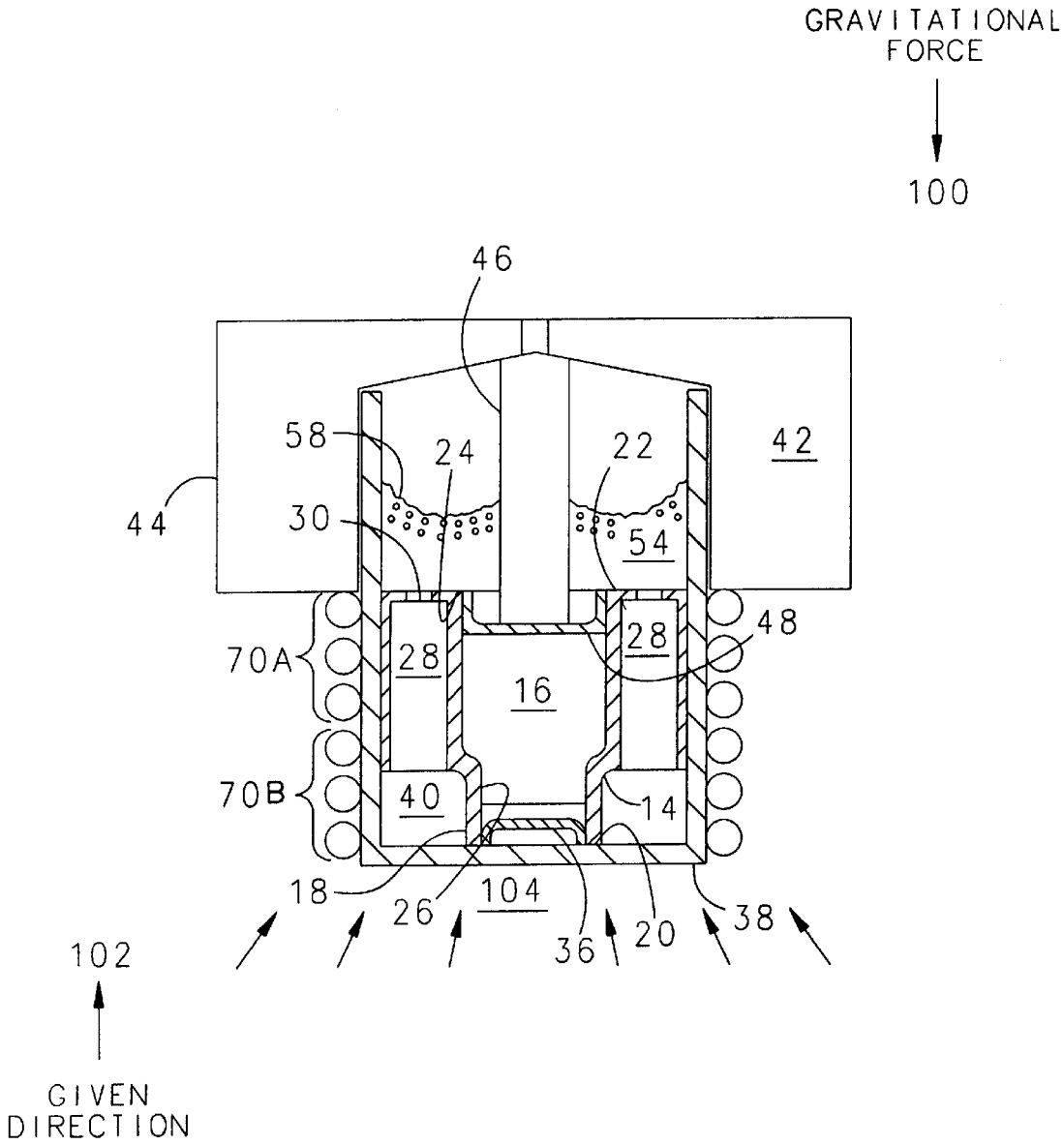
FIG. 7 is a schematic cross-section view of a cylinder block during the casting process of FIG. 6 in which the cylinder block is completely immersed in molten copper-based alloy.

FIGS. 6–7 illustrate another exemplary embodiment of the process 10. This embodiment is similar to the embodiment described in connection with FIGS. 1–5, but uses induction heating to heat the copper-based alloy, rather than using the vacuum furnace 50.

More specifically, the preparation and arrangement of the sealed assembly 16, the cylindrical container 38, the insulative housing 42, the threaded bolt 46, and the freeze plug 48 are the same as for the embodiment described in connection with FIGS. 1–5. Rather than using the vacuum furnace 50, one or more induction coils 70 surround the container 38 in the areas adjacent the mass of copper-based alloy 40. Preferably, an upper induction coil 70A and a lower induction coil 70B are provided and can be individually controlled to provide differential heating of the corresponding upper and lower portions of the mass of copper-based alloy 40. It should be noted that the annulus portion 44 of the insulative housing 42 has been reduced in length to allow clearance for the coil(s) 70. However, the annulus portion 44 still extends and translates along the length of the container 38 while substantially sealing and insulating the seal assembly 16 in the copper-based alloy 40 within the container 38.

After the components 16, 38, 42, 46 and 48 are arranged as shown in FIG. 6, the induction coil(s) 70 are used to heat the copper-based alloy 40 to a temperature of 1850° F.±50° F., which should be a molten state for the copper-based alloy 40. As the copper-based alloy 40 reaches the molten state, gravitational force acting via the weight of the carbon cover 42 and the sealed assembly 16 immerses the cylinder block 14 into the copper-based alloy 40. During heating, the graphite material of the housing 42 tends to more readily attract oxygen than the steel surfaces of the cylinder block 14, thereby reducing oxidation on the surfaces of the cylinder block 14 even though no vacuum has been applied around the cylinder block 14.

Optionally, if two induction coils 70A and 70B are provided, the heating of the copper-based alloy 40 can be controlled so that the cooper-based alloy heats generally from top to bottom. More specifically, the upper induction coil 70A can be controlled to induce eddy currents in the upper portion of the mass of copper-based alloy 40 before the lower coil 70B induces eddy currents in the lower portion of the mass of copper based alloy 40. In connection with this time sequenced control of the coils 70A and 70B, or as an alternative thereto, the upper induction coil 70A can be controlled to induce eddy currents at a first intensity in the upper portion of the mass of copper-based alloy 40 and the lower induction coil 70B can be controlled to induce eddy currents at a second intensity in the lower portion of the mass of copper-based alloy 40, with the first intensity being greater than the second intensity to ensure that the heating occurs in the desired direction.

Optionally, the casting process may begin by using the induction coil(s) 70 to pre-heat the mass of copper-based alloy 40 and the sealed assembly 16 to 950° F.±50° F. prior to heating to the copper-based alloy 40 to 1850° F.±50° F.

As illustrated in FIG. 7, after the first end 18 of the cylinder block 14 immerses to the bottom of the container 38, it is preferable to hold the sealed assembly 16 and the copper-based alloy 40 at a temperature of 1850° F.±50° F. for a period of 30 seconds to 5 minutes. This time frame allows the copper-based alloy 40 and the steel materials of the cylinder block 14 to react sufficiently to form a molten bond. Additionally, even though a vacuum has not been applied, it is believed that this time frame and/or the directionality of heating will allow a significant amount of any entrained gas and impurities in the copper-based alloy to migrate through the piston bores 28 and the piston bore passage 30 in the direction of vector 102. Thus, as with the embodiment described in connection with FIGS. 1 and 5, this "bottom casting" arrangement enables control of the direction of immersion of the cylinder block 14 in conjunction with the direction of movement of entrained gas.

After the heating described above, the mass of copper-based alloy 40 and the sealed assembly 16 are cooled. Preferably, the cooling is controlled so that the copper-based alloy 40 and the sealed assembly cool in a direction 102. This can be accomplished by quenching the container 38 adjacent the first end 18 with $N_2$ gas, as illustrated by vectors 104 in FIG. 4, to cool the sealed assembly 16 and copper based alloy 40 to less than 150° F. Either with or without the quenching, if two induction coils are provided, the induction coil 70A can be used to induce eddy currents in the upper portion of the mass of copper-based alloy 40 to further ensure that the cooling occurs in the desired direction 102. As another option, again either with or without the quenching, the induction coil 70A can be controlled to induce eddy currents at a first intensity in the upper portion of the mass of copper-based alloy 40 and the induction coil 70B can be controlled to induce eddy currents at a second intensity in the lower portion of the mass of copper-based alloy 40, with the first intensity being greater than the second intensity to ensure that the cooling occurs in the desired direction.

As with the embodiment described in connection with FIGS. 1–5, the above-described cooling of the copper-based alloy 40 from adjacent the first end 18 of the cylinder block 14 further promotes migration of entrained gas within the alloy 40 to the extreme portion 54. This "bottom cooling" effect is enhanced because of the carbon housing 42 thermally insulates the second end 22 of the copper-based alloy 14. In such an arrangement, the copper-based alloy 40 does not instantaneously cool from liquid to solid, but rather gradually cools and changes state beginning from adjacent the first end 18 and ending at the extreme portion 54.

After the copper-based alloy 40 and the sealed assembly 16 have been cooled to below 150°, the copper-based alloy 40 and the sealed assembly 16 are preferably allowed to air cool to room temperature. The remainder of the induction heating embodiment preferably is performed exactly the same as for the vacuum furnace embodiment described in connection with FIGS. 1–5. Accordingly, this embodiment of the process produces a finished cylinder block 14 as illustrated in FIG. 5.

Thus it can be seen that the induction heating embodiment described in connection with FIGS. 6 and 7 differs from the vacuum furnace embodiment only in that the heating is accomplished with the induction coil(s) 70, rather than the vacuum furnace 50, and the cooling of the copper-based alloy 40 and the cylinder block 14 can be controlled using the induction coils 70A and 70B, with or without quenching.

Numerous modifications in the alternative embodiments of the invention will be apparent to those skilled in the art in view of the foregoing description. For example, the copper-based alloy annular member 66 may integrally include the annular plate member 32 as a projection extending radially outward from a portion of the annular member 66 which is adjacent to the bearing surface 24 of the cylinder block 14.

Accordingly, this description is to be construed as illustrative only and is for the purpose of enabling those skilled in the art to make and use the invention and teaching the best mode of carrying out the invention. The exclusive rights of all modifications which fall within the scope of the appended claims is reserved.

What is claimed is:

1. A method of casting a copper-based alloy to a cylinder block, the cylinder block having a first end, a second end opposite the first end, and at least one cavity, the method comprising the steps of:

placing the first end of the cylinder block adjacent a mass of copper-based alloy; and heating the mass of copper-based alloy to a molten state where at least the first end of the cylinder block is immersed into the mass of copper-based alloy by a force applied to the cylinder block and the mass of copper-based alloy.

2. The method of claim 1 wherein said force is a gravitational force directed at the mass of copper-based alloy.

3. The method of claim 1 further comprising the step of providing a thermally insulative housing for insulating the second end of the cylinder block.

4. The method of claim 3 wherein said force is a gravitational force directed at the mass of copper-based alloy and includes a weight of the insulative housing.

5. The method of claim 1 wherein the heating step includes heating the mass of cooper based alloy to induce entrained gas contained within the mass of copper-based alloy to migrate in a desired direction.

6. The method of claim 1 further comprising the step of cooling the mass of copper-based alloy and the immersed cylinder block to induce entrained gas contained within the mass of copper-based alloy to migrate in a desired direction.

7. The method of claim 1 further comprising the step of cooling the mass of copper-based alloy and the immersed cylinder block in a given direction beginning from the first end of the cylinder block and moving toward the second end of the cylinder block.

8. The method of claim 1 further comprising the step of providing a mass of carbon adjacent the cylinder block and the mass of copper-based alloy to reduce oxidation on the surface of the cylinder block as the cylinder block is immersed into the mass of copper-based alloy.

9. The method of claim 1 wherein the heating step comprises heating the mass of copper-based alloy to a molten state where the entire cylinder block is immersed into the mass of copper-based alloy by said force.

10. The method of claim 1 wherein the heating step comprises induction heating the mass of copper-based alloy to a molten state where at least the first end of the cylinder block is immersed into the mass of copper-based alloy by said force.

11. The method of claim 10 wherein the induction heating step comprises induction heating the mass of copper-based alloy to a molten state where the entire cylinder block is immersed into the mass of copper-based alloy by said force.

12. The method of claim 10 further comprising the step of inducing eddy currents in a one portion of the mass of copper-based alloy while quenching another portion of the mass of copper-based alloy while the cylinder block is immersed into the mass of copper-based alloy.

13. The method of claim 10 further comprising the step of inducing first eddy currents at a first intensity in one portion of the mass of copper-based alloy and second eddy currents at a second intensity in another portion of the mass of cooper-based alloy, the first intensity being greater than the second intensity to induce entrained gas contained within the mass of copper-based alloy to migrate toward the one portion.

14. A method of casting a copper-based alloy bushing to a bore of a machine component, the method comprising the steps of:

placing the machine component adjacent a mass of copper-based alloy;

after the placing step, heating the mass of copper-based alloy to a molten state where a force applied to the machine component and the mass of copper-based alloy immerses at least a portion of the machine component into the mass of copper-based alloy with at least some of the copper-based alloy flowing into at least a portion of said bore;

cooling the mass of copper-based alloy and the machine component to solidify the mass of copper-based alloy; and removing a portion of the copper-based alloy in said bore to form a cast copper-based alloy bushing in said bore.

15. The method of claim 14 wherein said force is a gravitational force directed at the mass of copper-based alloy.

16. The method of claim 14 wherein the heating step includes heating the mass of cooper based alloy to induce entrained gas contained within the mass of copper-based alloy to migrate in a desired direction.

17. The method of claim 14 wherein the heating step comprises heating the mass of copper-based alloy to a molten state where the entire machine component is immersed into the mass of copper-based alloy by said force.

18. The method of claim 14 wherein the heating step comprises induction heating the mass of copper-based alloy to a molten state where said force immerses at least a portion of the machine component into the mass of copper-based alloy with at least some of the copper-based alloy flowing into at least a portion of said bore.

19. A method of casting a copper-based alloy bushing to a bore of a machine component, the method comprising the steps of:

placing the machine component adjacent a mass of copper-based alloy;

heating the mass of copper-based alloy to a molten state where a force applied to the machine component and the mass of copper-based alloy immerses at least a portion of the machine component into the mass of copper-based alloy with at least some of the copper-based alloy flowing into at least a portion of said bore;

cooling the mass of copper-based alloy and the immersed machine component to induce entrained gas contained within the mass of copper-based alloy to migrate in a desired direction;

cooling the mass of copper-based alloy and the machine component to solidify the mass of copper-based alloy; and removing a portion of the copper-based alloy in said bore to form a cast copper-based alloy bushing in said bore.

20. A method of casting a copper-based alloy bushing to a bore of a machine component, the method comprising the steps of:

placing the machine component adjacent a mass of copper-based alloy;

heating the mass of copper-based alloy to a molten state where a force applied to the machine component and the mass of copper-based alloy immerses at least a portion of the machine component into the mass of copper-based alloy with at least some of the copper-based alloy flowing into at least a portion of said bore;

providing a mass of carbon adjacent the machine component and the mass of copper-based alloy to reduce oxidation on the surface of the machine component as the cylinder block is immersed into the massive copper-based alloy;

cooling the mass of copper-based alloy and the machine component to solidify the mass of copper-based alloy; and removing a portion of the copper-based alloy in said bore to form a cast copper-based alloy bushing in said bore.

21. A method of casting a copper-based alloy bushing to a bore of a machine component, the method comprising the steps of:

placing the machine component adjacent a mass of copper-based alloy;

heating the mass of copper-based alloy to a molten state where a force applied to the machine component and the mass of copper-based alloy immerses at least a portion of the machine component into the mass of copper-based alloy with at least some of the copper-based alloy flowing into at least a portion of said bore;

inducing eddy currents in one portion of the mass of copper-based alloy while quenching another portion of the mass of copper-based alloy while the machine component is immersed into the mass of copper-based alloy;

cooling the mass of copper-based alloy and the machine component to solidify the mass of copper-based alloy; and removing a portion of the copper-based alloy in said bore to form a cast copper-based alloy bushing in said bore.

22. A method of casting a copper-based alloy bushing to a bore of a machine component, the method comprising the steps of:

placing the machine component adjacent a mass of copper-based alloy;

induction heating the mass of copper-based alloy to a molten state where a force applied to the machine component and the mass of copper-based alloy immerses at least a portion of the machine component into the mass of copper-based alloy with at least some of the copper-based alloy flowing into at least a portion of said bore;

inducing first eddy currents at a first intensity in one portion of the mass of copper-based alloy and second eddy currents at a second intensity in another portion of the mass of copper-based alloy, the first intensity being greater than the second intensity to induce entrained gas contained within the mass of copper-based alloy to migrate toward the one portion;

cooling the mass of copper-based alloy and the machine component to solidify the mass of copper-based alloy; and removing a portion of the copper-based alloy in said bore to form a cast copper-based alloy bushing in said bore.

* * * * *